United States Patent [19]

Boone

[11] Patent Number: 4,465,212

[45] Date of Patent: Aug. 14, 1984

[54] LIQUID DISPENSING DEVICE

[75] Inventor: Jacob J. Boone, Vermilion, Ohio

[73] Assignee: Nordson Corporation, Amherst, Ohio

[21] Appl. No.: 400,373

[22] Filed: Jul. 21, 1982

Related U.S. Application Data

[63] Continuation of Ser. No. 148,577, May 9, 1980, abandoned.

[51] Int. Cl.[3] ..... B65D 5/72

[52] U.S. Cl. ..... 222/504; 222/559; 251/333

[58] Field of Search ..... 222/559, 567, 571, 575, 222/504; 425/564, 568; 251/333; 239/569, 583, 584, 585

[56] References Cited

U.S. PATENT DOCUMENTS 1,652,409 12/1927 Moulthrop ..... 219/421 X 3,952,927 4/1976 Schaumburg ..... 222/510

FOREIGN PATENT DOCUMENTS 2554501 8/1976 Fed. Rep. of Germany ..... 425/564

*Primary Examiner*—Joseph J. Rolla
*Assistant Examiner*—Frederick R. Handren
*Attorney, Agent, or Firm*—Wood, Herron & Evans

[57] ABSTRACT

A liquid dispensing device is disclosed in which there is a movable needle valve operable to open and close a valve seat located within the nozzle of the dispensing device. The needle valve is guided by a guide bushing contained within the nozzle bore. A very small radiused semi-spherical end surface on the nozzle has been found to eliminate stringing of viscous liquid materials dispensed from the nozzle, particularly when the end surface is combined with a needle valve which is maintained concentric with the nozzle orifice by the guide bushing contained within the nozzle bore.

8 Claims, 3 Drawing Figures

LIQUID DISPENSING DEVICE

This is a continuation of application Ser. No. 148,577 filed May 9, 1980, now abandoned.

This invention relates to liquid dispensing devices and particularly to devices adapted for dispensing relatively viscous sticky substances such as adhesives, hot melts, sealing compounds, etc.

There are many applications for dispensers in which it is desirable or necessary to sharply cut off the flow of liquid from the nozzle of the device without any drooling, dripping, or stringing of the liquid from the nozzle after closing of the nozzle. To that end there has been a long standing need for a dispensing device which would sharply cut off the flow of liquid from the nozzle when the valve of the nozzle is closed. One such attempt at such sharp cut off of flow is disclosed in U.S. Pat. No. 3,923,252. According to the disclosure of this patent, sharp cut off may be obtained by maintaining the conically shaped needle valve of the device centered within a frustoconical seat of that device. To that end centering bushings are located within the device through which the needle valve must pass.

Another patent which recognizes the desirability of minimizing dripping or stringing from a nozzle orifice as a desirable end is U.S. Pat. No. 3,841,567. According to the disclosure of this patent, dripping or stringing of viscous liquid from the nozzle orifice after cut off of flow may be minimized by maintaining a minimum volume cavity between the cut off valve and the nozzle orifice of the device.

I have discovered and one aspect of this invention is predicated upon the discovery that sharp cut off of flow without stringing from a nozzle of a dispensing device may be achieved by providing a small orifice in a very small radius semi-spherical end surface of the nozzle. In the preferred embodiment, the nozzle orifice is only 0.020 inch in diameter and the nozzle tip is semi-spherical in shape and only 0.084 inch in radius. A nozzle thus configurated and having a frustoconical valve seat located immediately adjacent the nozzle orifice has been found to result in a nozzle which materially reduces the amount of stringing of material between the nozzle and substrate upon which the material is being deposited.

I have further found that improved seating of the needle valve on the valve seat with a consequent reduction of dripping or drooling or stringing from the nozzle may be achieved by providing a needle valve guide surface within a bushing contained in the nozzle and located immediately adjacent the nozzle valve seat. To that end, the nozzle of this invention includes a guide bushing press fit into the nozzle and having peripheral channels or grooves through which liquid may flow from the interior of the device to the valve seat.

The primary advantage of this invention is that it provides very sharp cut off of liquid flow from the nozzle whenever the valve of the dispensing device is closed. Consequently, there is no dripping of liquid from the device after valve closing. If the device is used to dispense very viscous substances such as adhesive or sealing compounds, this unique nozzle and needle valve guide structure materially reduces stringing of the viscous substance between the nozzle orifice and the substrate on which the viscous substance is deposited.

These and other objects and advantages of this invention will be more readily apparent from the following description of the drawings in which.

Figure 1:
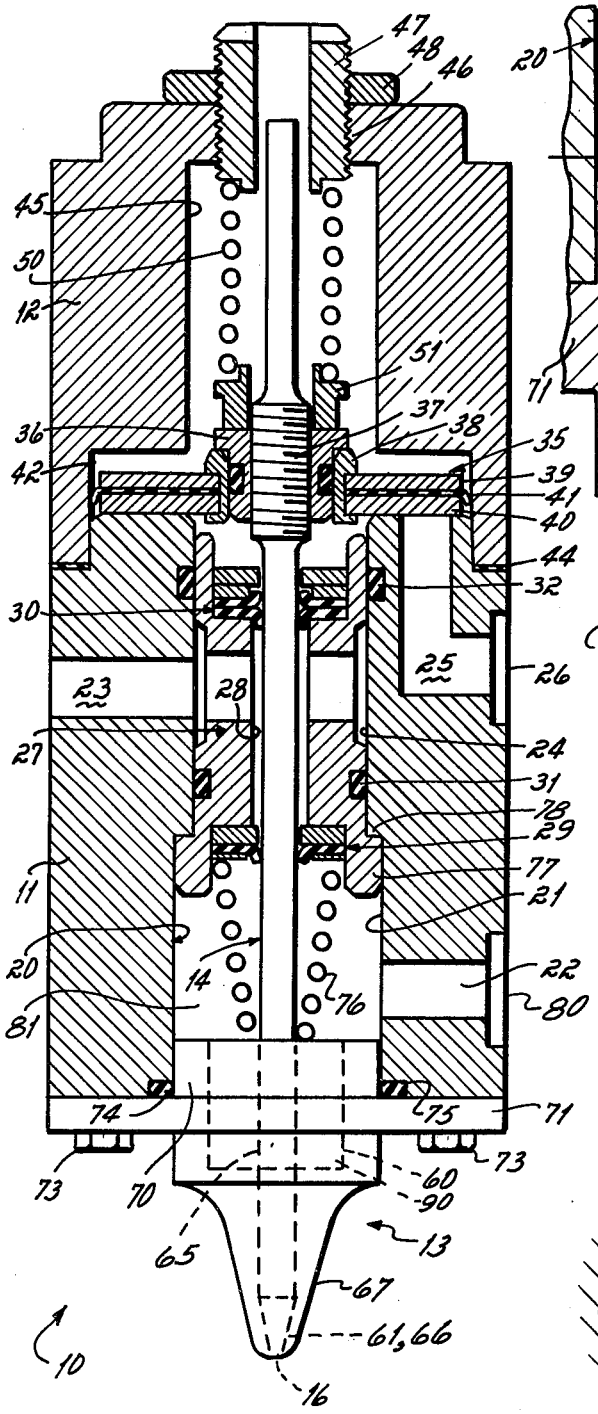
FIG. 1 is a cross sectional view of a dispensing device incorporating the invention of this application.
Figure 2:
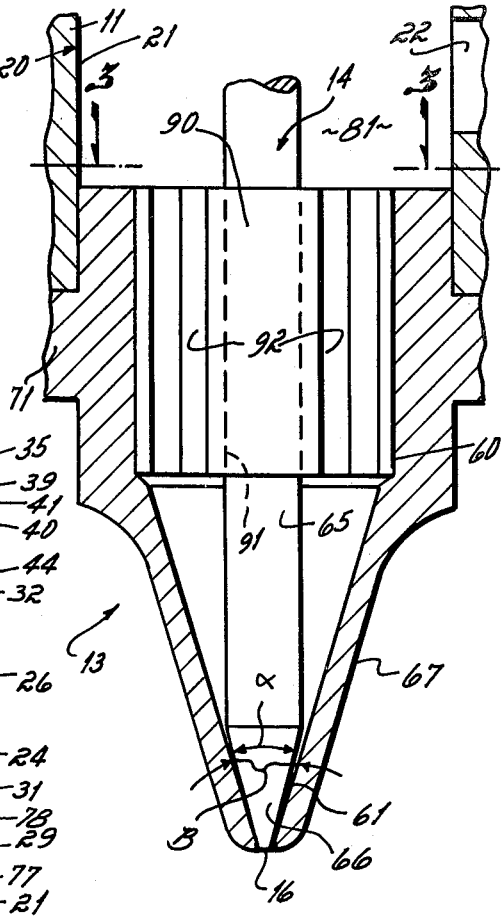
FIG. 2 is an enlarged cross sectional view of the nozzle and nozzle orifice of the dispensing device illustrated in FIG. 1.

Referring to FIGS. 1 and 2, the invention of this application is illustrated as being embodied in a dispensing gun 10. This gun 10 includes a generally cylindrical body 11, an end cap 12, and a nozzle 13. The end cap 12, body 11, and nozzle 13 all have a longitudinal bore extending therethrough within which there is located an axially movable needle valve 14 for controlling flow of liquid from the orifice 16 of the nozzle 13.

The valve body 11 contains a stepped axial bore 20, the larger diameter section 21 of which is located at the forward end of the body. This larger diameter section 21 is intersected by a transverse passage 22 through which liquid is supplied to the gun. Additionally, a vent port 23 intersects the smaller diameter section 24 of the bore 20. There is also an air inlet passage 25 which connects the rear end of the valve body with an inlet air port 26.

A bushing 27 is located within the bore 20 of the body 11. This bushing supports seal assemblies 29 and 30 within a bore 28 which extends longitudinally through the bushing.

To prevent fluid flow around the busing 27, there is an annular groove in the surface of the bushing within which there is an O-ring seal 31. Additionally, there is an O-ring seal 32 contained within an annular channel formed in the valve body 11.

There is a piston assembly 35 mounted upon the needle valve 14 for controlling movement of the needle valve 14. This piston assembly comprises a nut 36 threaded onto a threaded section 37 of the needle valve and a piston retainer ring 38 sealingly secured onto the periphery of the nut 36. This retainer ring carries a pair of piston rings 39, 40 between which there is sandwiched a resilient gasket 41. The outer edge of this gasket 41 contacts the interior surface of a cylinder 42 formed on the interior of the end cap so as to form a pneumatic seal between the lower side of the piston and the surface of the cylinder 42.

The end cap 12 is bolted onto the upper end of the body 11 by bolts (not shown). Preferably, a resilient gasket seal 44 is located between the contacting surfaces of the end cap and the body.

Communicating with the cylinder 42 formed in the end cap 12, there is a stepped axial bore 45 which extends through the end cap. The upper smaller diameter section 46 of this stepped bore is threaded and receives an adjustment stud 47. A lock nut 48 secures the stud 47 in a position of axial adjustment.

Between the bottom surface of the stud 47 and the top of the piston asssembly 35, there is a compression spring 50. The upper end of this compression spring 50 contacts the bottom surface of the stud 47 and the lower end of the spring 50 contacts the top surface of a spring retainer 51. This spring retainer is supported upon the top surface of the piston assembly nut 36. By adjusting the axial position of the stud 47 within the bore 46, the closing force for retaining the needle valve closed may be adjusted or varied.

The dispensing device heretofore described except for the configuration of the needle valve 14 and the nozzle 13, is conventional and per se, forms no part of the invention of this application. Otherwise expressed, the invention of this application resides in the construction of the needle valve 14 and the nozzle 13.

Figure 3:
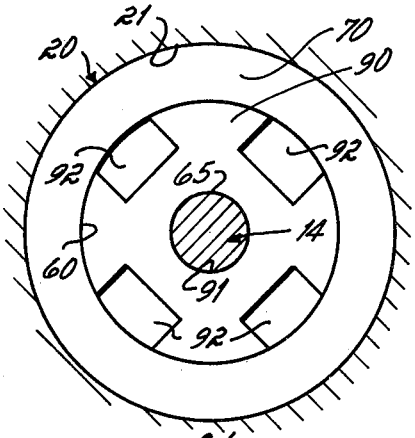
FIG. 3 is a cross sectional view taken on line 3—3 of FIG. 2.

With particular reference to FIGS. 2 and 3, it will be seen that the nozzle 13 contains a generally cylindrical axial bore 60 which extends forwardly from the rear of the nozzle until it intersects a frustoconical valve seat 61 at the forward end of the nozzle. This frustoconical valve seat 61 in turn communicates with a small cylindrical nozzle orifice 16 through which liquid exits from the nozzle. In a preferred embodiment, this orifice is approximately 0.020 inch in diameter and the valve seat 61 defines an included angle of 34°.

Press fit into the bore 60 there is a guide bushing 90. This bushing 90 has a central axial bore 91 through which a needle valve 14 passes. Additionally, it has four equidistantly spaced longitudinal channels or grooves 92 in its peripheral surface through which liquid may flow from the interior of the gun body 11 to the nozzle orifice 16 as is explained more fully hereinafter.

At its forward end the needle valve 14 has a cylindrical section 65 slideably received within the bore 91 of the guide bushing 90. This sliding fit requires that the bore 91 be slightly larger than the cylindrical section 65 of the needle, but that there be no more than approximately 0.002 inch clearance between the bore and the needle valve. Preferably, the clearance is approximately 0.001 inch.

At its forward end the needle valve 14 terminates in a frustoconical shaped valve section 66 engageable with the frustoconical shaped valve seat 61 in the nozzle 13. The frustoconical shaped end section 66 of the needle valve defines an included angle $\alpha$ of approximately 30° while the valve seat 61 defines an included angle B of approximately 34°. The exterior surface 67 of the nozzle tip is also tapered at approximately 34°. Consequently, there is some slight clearance between the frustoconical shaped section of the needle valve 65 and the valve seat 61 at the rearward end of the valve seat.

The nozzle 13 has a cylindrical hub section 70 which is tightly fitted within the large diameter section 21 of cylindrical bore 20 in the body 11. Forwardly of the hub section 70, there is a flange 71 which is bolted to the forward end of the body 11 by conventional threaded connectors 73. Preferably, there is an O-ring seal 74 contained within a channel 75 formed in the forward end of the dispenser body 11. This seal 74 prevents any leakage of liquid between the nozzle 13 and the body 11.

To prevent any movement of the bushing 27 within the bore 20, there is a spring 76 located between the rearward end of the nozzle 13 and the forward end of the bushing seal assembly 29. This spring 76 biases the bushing rearwardly and maintains a flange 77 of the bushing engaged with a shoulder 78 formed in the bore 20.

In operation, liquid under pressure is supplied to the liquid inlet port 80 of the device. This port communicates via passage 22 with the bore 20 of the body 10 such that liquid supplied to the port 80 flows into a liquid storage chamber 81 contained within the device. This chamber 81 is in turn open to the longitudinal passages 92 within the guide bushing 90.

Whenever the device is to be actuated so as to permit liquid to flow from the storage chamber 81 through the passages 92 and past the valve seat 61 to the orifice 61, high pressure air is supplied to the port 26. This high pressure air overcomes the bias of the spring 50 and causes the piston assembly 35 to move upwardly, carrying with it needle valve 14. This upward movement of the needle valve results in the lifting of the conical section 66 of the valve off of the seat 61 and, results in flow of liquid from the storage chamber 81 through the passages 92 via the valve to the orifice 16. This flow continues so long as the air pressure is maintained to the port 26. When that air pressure is relieved, as for example by actuation of a controlling pneumatic valve (not shown) the spring 50 effects closing movement of the valve.

The most important advantage of this invention resides in the fact that when it is used to dispense high viscosity liquids such as adhesives or sealing gasket material compounds, etc., it materially eliminates or reduces stringing of material from the nozzle orifice after valve closing. This advantage is apparently partially attributable to the needle valve guide surface being in close proximity to the nozzle valve seat and partially attributable to the small radius semi-spherical tip on the nozzle. The needle valve guide surfaces on the guide bushing apparently maintains the needle valve concentric to the valve seat with the result that sharp cut off of flow and the reduction or elimination of stringing is enhanced and apparently the small radius semi-spherical tip on the nozzle also contributes to this reduction.

While I have described only a single preferred embodiment of my invention, persons skilled in this art will appreciate changes and modifications which may be made without departing from the spirit of my invention. Therefore, I do not intend to be limited except by the scope of the following appended claims:

I claim:

1. A device for dispensing viscous liquids comprising a nozzle having an axial bore therein, said bore having a frustoconical valve seat formed therein, said frustoconical valve seat terminating at a nozzle outlet orifice, an axially movable needle valve having a generally conically shaped section on the distal end thereof, said conically shaped distal end section of said needle valve being engageable with said frustoconical valve seat to close said valve, a bushing located within said nozzle, said bushing having a needle valve guide surface formed therein, said needle valve guide surface being engageable with said needle valve at a location spaced from said valve seat so as to guide movement of said needle valve along a longitudinal axis concentric to said valve seat, passageway means for supplying liquid to said nozzle bore forwardly of said bushing, and means for minimizing stringing of the viscous liquids from the nozzle orifice after closing of the needle valve on the valve seat, said means including a tip on said nozzle having an exterior surface which tapers inwardly toward said nozzle orifice, said tip terminating in a semi-spherical end surface, and said nozzle orifice being located in said semi-spherical end surface so that there is no cavity between the distal end of said needle valve and said nozzle orifice.

2. The liquid dispensing apparatus of claim 1 wherein said passageway means is formed by longitudinal grooves located in said bushing, said grooves being remote from said needle valve guide surface such that said grooves do not interrupt said guide surface.

3. The liquid dispensing device of claim 1 wherein said needle valve guide surface extends over a substantial portion of the axial length of said nozzle.

4. A device for dispensing viscous liquids comprising a body having an axial bore therein, a liquid storage chamber defined at least in part by said bore, a nozzle having an axial bore therein, said bore of said nozzle being in fluid communication with said bore of said body, said nozzle bore having a frustoconical valve seat terminating at a nozzle outlet orifice, an axially movable needle valve having a generally conical section of the distal end thereof, said conical section of said needle valve being engageable with said frustoconical valve seat to close said valve, and means for minimizing stringing of viscous material from the nozzle orifice after closing of said needle valve on said valve seat, said last named means comprising a tip on said nozzle having an exterior surface which tapers inwardly toward said nozzle orifice, said tip terminating in a semi-spherical end surface having a radius of approximately 0.084 inch and said distal end of said needle valve terminating at said nozzle orifice so that there is no cavity between the distal end of the needle valve and the nozzle orifice.

5. The device of claim 4 wherein said taper of said exterior surface of said nozzle tip defines an included angle of approximately 34°.

6. A liquid dispensing device comprising a body having an axial bore therein, a nozzle mounted in one end of said bore, said nozzle having an axially extending bore, a generally frustoconical shaped valve seat formed in said nozzle bore, said valve seat terminating in a forwardly disposed outlet orifice, a needle valve having a generally conically shaped valve portion on the distal end thereof engageable with said valve seat, said needle valve being axially movable within said bores of said body and said nozzle, fluid motor means mounted in said bore of said body for effecting movement of said needle valve into and out of sealing engagement with said valve seat, guide means comprising a guide bushing located within said nozzle and having an axial bore guide surface engageable with an intermediate cylindrical section of said needle valve to guide movement of said needle valve along a longitudinal axis concentric to said valve seat, passageway means for supplying liquid to said nozzle bore forwardly of said guide bushing, said passageway means being remote from said axial bore guide surface of said guide busing such that said passageway means does not intersect and interrupt said axial bore guide surface of said guide bushing, and means for minimizing stringing of the viscous liquids from the nozzle orifice after closing of the needle valve on the valve seat, said means including a tip on said nozzle having an exterior surface which tapers inwardly toward said nozzle orifice, said tip terminating in a semi-spherical end surface, and said nozzle orifice being located in said semi-spherical end surface of the nozzle so that there is no cavity between the distal end of said needle valve and said nozzle orifice.

7. The liquid dispensing device of claim 6 in which said bore of said guide bushing is engageable with said needle valve over a substantial portion of the axial length of said nozzle.

8. The liquid dispensing device of claim 6 wherein said passageway means comprises a plurality of longitudinally extending grooves formed in the peripheral surface of said guide bushing.

* * * * *